US008926317B2

(12) United States Patent
Farrell et al.

(10) Patent No.: US 8,926,317 B2
(45) Date of Patent: Jan. 6, 2015

(54) SYSTEM AND METHOD FOR CONTROLLING FIRED HEATER OPERATIONS

(75) Inventors: John T. Farrell, High Ridge, NJ (US); San Chhotray, Centerville, VA (US); Gary T. Dobbs, Fairfax, VA (US); Manuel S. Alvarez, Warrenton, VA (US); Patrick D. Schweitzer, Broad Run, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 693 days.

(21) Appl. No.: 12/636,933

(22) Filed: Dec. 14, 2009

(65) Prior Publication Data

US 2010/0151397 A1 Jun. 17, 2010

Related U.S. Application Data

(60) Provisional application No. 61/193,662, filed on Dec. 15, 2008.

(51) Int. Cl.

| | |
|---|---|
| ***F23J 7/00*** | (2006.01) |
| ***F23N 5/16*** | (2006.01) |
| ***F23N 5/18*** | (2006.01) |
| *F23N 1/02* | (2006.01) |
| *F23M 3/04* | (2006.01) |

(52) U.S. Cl.

CPC .. *F22N 5/08* (2013.01); *F23N 5/16* (2013.01); *F23N 5/18* (2013.01); *F23L 2900/07003* (2013.01); *F23N 2029/20* (2013.01)

USPC ... 431/4; 431/12; 431/10; 431/75; 60/39.091; 60/301

(58) Field of Classification Search

CPC ..... F01N 3/08; F23C 13/00; F23D 14/22; F23D 14/26; F23D 14/84; F23G 2207/50; F23J 2215/10; F23K 2301/103; F23L 7/00; F23N 1/022; F23N 1/082; F23N 5/082; F23N 5/08; F23N 5/16; F23N 5/18; F23N 2029/20; F23R 3/18

USPC ..... 431/19, 12, 25, 63, 75–80, 4, 10; 60/39.091, 301, 300, 749

See application file for complete search history.

(56) References Cited

U.S. PATENT DOCUMENTS 4,505,668 A 3/1985 DiBiano et al.
5,077,550 A * 12/1991 Cormier ..... 340/578

(Continued)

FOREIGN PATENT DOCUMENTS

DE 102004028473 A1 12/2005
EP 1998114 A2 3/2008

(Continued)

OTHER PUBLICATIONS

"12636933_465048 ProQuest Search—NPL.pdf"; STIC search results—Non Patent Literature; Sep. 18, 2014.*

(Continued)

*Primary Examiner* — Kang Hu
*Assistant Examiner* — Daniel E Namay
(74) *Attorney, Agent, or Firm* — Glenn T. Barrett; Andrew T. Ward

(57) ABSTRACT

Method of controlling the operation of a combustion device to provide safe and reliable operation while reducing NOx emission that includes providing a flow of fuel and diluent at a determined volume ratio to a flame in the combustion device; providing a flame stability sensor to generate a measurement of a characteristic of the flame, providing a flow measurement for each of the fuel and diluent, and controlling the determined volume ratio of fuel:diluent using the measurement from the flame stability sensor and/or flow measurements. A combustion system incorporating this method also is included.

39 Claims, 5 Drawing Sheets

(56) References Cited

U.S. PATENT DOCUMENTS

| | | | | |
|---|---|---|---|---|
| 5,252,060 | A * | 10/1993 | McKinnon et al. | 431/12 |
| 5,284,438 | A * | 2/1994 | McGill et al. | 431/9 |
| 5,544,478 | A * | 8/1996 | Shu et al. | 60/773 |
| 6,063,633 | A * | 5/2000 | Willson, III | 436/37 |
| 6,135,760 | A * | 10/2000 | Cusack et al. | 431/79 |
| 6,986,658 | B2 * | 1/2006 | Stephens et al. | 431/115 |
| 7,104,784 | B1 | 9/2006 | Hasegawa et al. | |
| 7,353,140 | B2 * | 4/2008 | Daw et al. | 702/182 |
| 7,435,080 | B2 * | 10/2008 | Joklik et al. | 431/4 |
| 2002/0056276 | A1 | 5/2002 | Dalla Betta et al. | |
| 2002/0100874 | A1 * | 8/2002 | Carter et al. | 250/338.5 |
| 2003/0101725 | A1 | 6/2003 | Marin et al. | |
| 2003/0175640 | A1 * | 9/2003 | Stephens et al. | 431/9 |
| 2006/0015298 | A1 * | 1/2006 | Daw et al. | 702/188 |
| 2006/0046218 | A1 | 3/2006 | Joklik et al. | |
| 2008/0175774 | A1 * | 7/2008 | Morrison et al. | 423/210 |

FOREIGN PATENT DOCUMENTS

| | | | | |
|---|---|---|---|---|
| JP | 63259126 | A * | 10/1988 | F02C 9/00 |
| WO | 0196722 | A1 | 12/2001 | |
| WO | 02/18759 | A1 | 3/2002 | |
| WO | 2005/071316 | A1 | 8/2005 | |
| WO | 2008116037 | A1 | 9/2008 | |

OTHER PUBLICATIONS

"12636933_465048 ProQuest Search—Patents.pdf"; STIC search results—Patent Literature; Sep. 18, 2014.*

PCT International Search Report issued Apr. 25, 2012 in corresponding PCT Application No. PCT/US2009/006562, 5 pages.

PCT Written Opinion issued Apr. 25, 2012 in corresponding PCT Application No. PCT/US2009/006562, 6 pages.

Singapore Search Report issued Nov. 20, 2012 in corresponding Singapore Application No. 2011-3320-6, 5 pgs.

Singapore Written Opinion issued Nov. 20, 2012 in corresponding Singapore Application No. 201103320-6, 7 pgs.

Hanson, "Advances in Tunable Diode Laser (TDL) Sensing for Combustion and Propulsion", http://www.comblab.ae.gatech.edu/hanson.pdf, May 18, 2006.

* cited by examiner

SYSTEM AND METHOD FOR CONTROLLING FIRED HEATER OPERATIONS

CROSS REFERENCE TO RELATED APPLICATIONS

The application relates and claims priority to U.S. Provisional Patent Application No. 61/193,662 to Farrell et al., filed on Dec. 15, 2008 entitled "NOx Reduction in Fired Heater Operations".

FIELD OF THE INVENTION

The present invention relates to methods and systems for safely and reliably reducing NOx emissions in fired heaters using fuel gas. In particular, the present invention relates to the control of the fired heater provide safe and reliable operation while reducing NOx emissions.

BACKGROUND OF THE INVENTION

Combustion devices in chemical processing and petrochemical production and refining operations are a major source of NOx emissions. Adiabatic flame temperature reduction is one method of reducing NOx emissions. Efforts to reduce flame temperature, such as increasing the air/fuel ratio and introducing flame diluents to the flame can lead to unstable flames, flame extinction, or flame blow-out that can create potentially dangerous operating conditions (e.g., flooding of the combustion device with unspent fuel).

Flame stability or instability sensors have been developed, and their use in combustion system control systems has been proposed. Increasing the air flow to provide fuel lean operation of the combustion device has also been proposed. However, exclusive reliance on air to reduce flame temperature presents its own set of challenges. For example, air contains a significant amount of oxygen, which is an oxidizing agent. If fuel is introduced to the air stream at an inappropriate location, this can create conditions for flame instability and/or a "flame out" to occur. In unstable and/or "flame out" conditions, the flame is either partly or fully extinguished such that flammable gas enters the furnace, potentially resulting in an explosion. This scenario is applicable to all fired heaters regardless of the process function or any scheme being employed to reduce NOx emissions.

There remains a need to achieve NOx reduction in combustion devices while maintaining a stable flame and safe operating conditions for the combustion device.

SUMMARY OF THE INVENTION

It has been found that NOx reduction can be achieved via use of flame diluents, while maintaining stable operation when the process control strategy is constrained by a flame stability sensor (e.g., Wavelength Modulated Tunable Diode Laser (TDL) sensors, pressure sensors, machine vision sensor systems, and other technologies that can be used detect flame instability). The present application provides a method for controlling the operation of a fired heater, which provides for safe operation of the heater while reducing NOx emissions and avoiding flame out conditions. The method includes by providing a flow system with means to control the flow of fuel and diluent at a determined volume ratio to a flame in the combustion device, providing a flame stability sensor to generate a measurement of a direct or indirect characteristic of a flame or flames related to flame stability, controlling the determined volume ratio of fuel:diluent fed to the combustion device as constrained by at least one of (i) a threshold value from at least one measurement from at least one flame stability sensor and (ii) a threshold volume ratio of fuel:diluent as measured from at least one flow sensor on each of the fuel source and diluent source in the flow system.

In one particular embodiment, the diluent is selected from one or more of nitrogen, steam (e.g., superheated steam), recycled combustion gas, carbon dioxide or other inert fluid (e.g., helium or argon). In a preferred embodiment, the diluent includes superheated steam and/or recycled combustion gas. In a further embodiment, the amount of diluent and/or fuel fed to the combustion device is adjusted based on a real-time control constraint that employs at least one flame stability sensor (i.e., laser optical sensor, pressure sensor, machine vision sensor system, etc.). In accordance with one aspect of the invention, the flame sensor is an acoustic sensor. Preferably, the acoustic sensor is a pressure sensor. The pressure sensor is preferably a pressure differential sensor. In accordance with another aspect of the present invention, the flame stability sensor is a machine vision sensor system. The machine vision sensor system preferably includes at least one camera. In accordance with yet another aspect of the invention, the flame sensor is a laser optical sensor. The laser optical sensor may be a wavelength modulated tunable diode laser (TDL) sensor system tuned to monitor one or more pre-selected wavelengths (e.g., about 1.4 μm corresponding to discrete $H_2O$ absorption features).

Another aspect of the present application provides a combustion system that includes a combustion device, a fuel source, a diluent source, a flow system in communication with the fuel source and the diluent source to provide a flow of fuel and diluent at a determined volume ratio to a flame in the combustion device, a flame stability sensor to generate a measurement of a direct or indirect characteristic of the flame that changes as a function of flame stability, flame instability, and/or the approach to lean blowout (LBO), and at least one controller to control the determined volume ratio of fuel: diluent as constrained by a flame stability threshold value or values derived from one or more flame stability sensors and/or a volume ratio of fuel:diluent threshold value derived from at least one flow sensor on each of the fuel source and diluent source in the flow system. The combustion system controls the operation of the fired heater resulting in safe operation while reducing NOx emissions.

DETAILED DESCRIPTION OF THE INVENTION

Definitions

Figure 1:
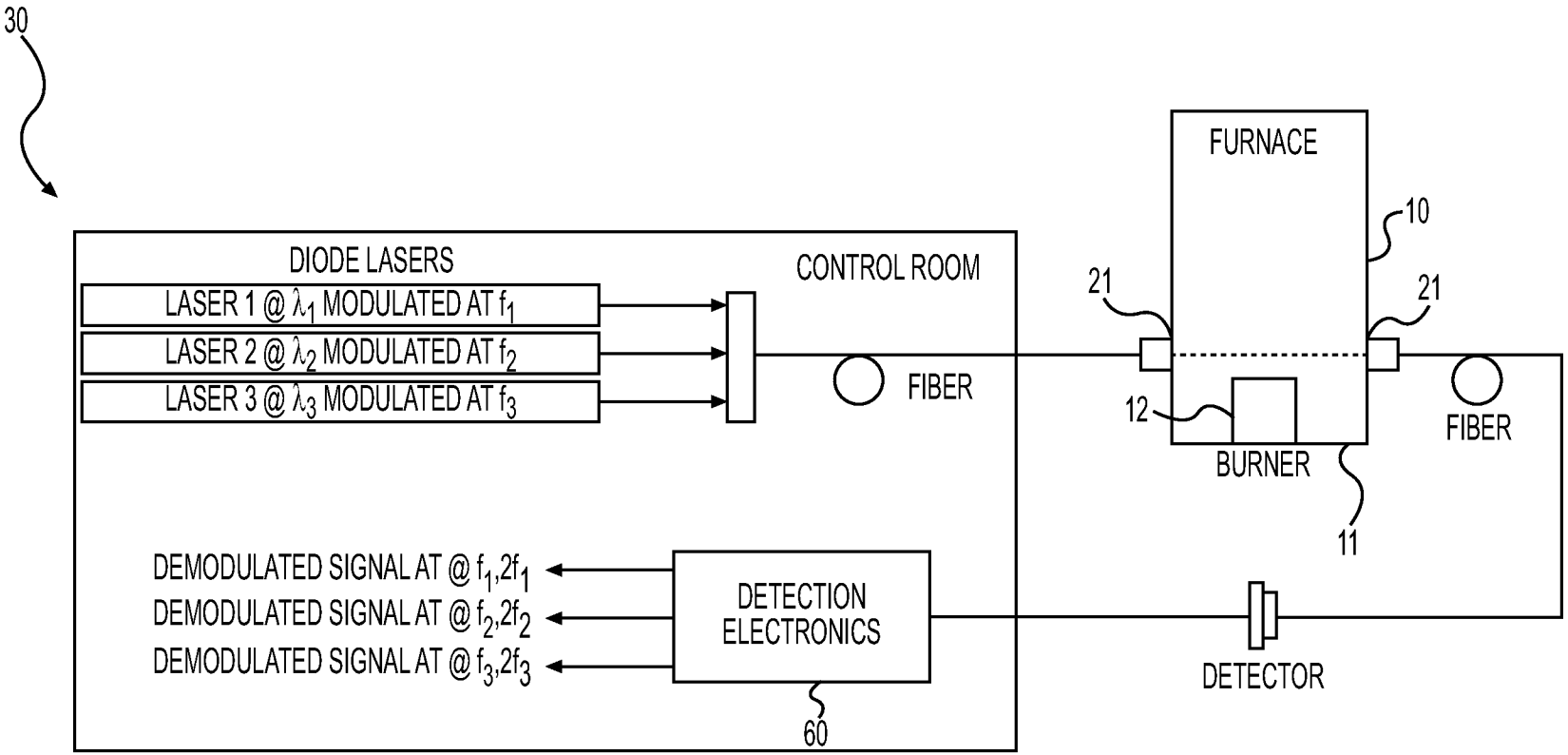
FIG. 1 sets forth information about a wavelength-multiplexed, wavelength modulated TDL Sensor that can be used in methods and systems of the present application.

As used herein, the term "diluent" refers to any fluid that is not flammable (or in one embodiment, substantially not flammable) and is not an oxidizing element or agent, or any mixture of fluids that does not contain a flammable component and does not contain an oxidizing element or agent as a component. Because air generally contains about 21 vol % of oxygen as a component, which is an oxidizing element, it is understood that air is not a diluent as that term is used herein.

As used herein, the term "fuel" refers to any fluid that is flammable material. Non-limiting examples of fuels include, but are not limited to, natural gas, refinery gas, gasoline, flammable or combustible volatile organic compounds or other flammable/combustible waste products from a chemical processing or petrochemical refining operations, biomass-derived fuels, coal gas or other hydrocarbon-based flammable/combustible substances.

As used herein, the "volume ratio of fuel:diluent" excludes air. As noted above, air is not a diluent as that term is used in this application. The volume ratio of fuel:diluent is the volume of all fuels fed to the flame for a given time period (numerator)/the volume of all diluents fed to the flame for that same given time period (denominator). This definition also applies to the converse relationship for the volume ratio of diluent:fuel.

As used herein, the term "near-infrared region" refers to a wavelength from about 0.7 μm to about 1.6 μm.

As used herein, the term "flame stability sensor" refers to any device or collection of devices configured to provide an actionable signal that gives an indication as to the state of stability, instability, and/or likelihood of a flame to be extinguished or blow-out based on a measured characteristic, either directly or indirectly, of a flame or flames by the sensor and/or sensor system used. The devices include but are not limited to optical sensors, acoustic sensors, and machine vision sensors. Although the present specification describes specific examples of flame stability sensors below, it is understood that such descriptions are provided for purposes of illustration and is not limited to the examples given. In various embodiments of the present application, any flame stability sensor, including flame stability sensors and/or flame monitoring sensors known in the art and yet not discussed herein, can be used in the methods and systems of the present application. It is also contemplated that the devices described herein may be used alone or in combination with each other (e.g., multiple optical sensors, multiple pressure sensors, machine vision sensors (e.g., camera), optical sensors in combination with pressure and/or machine vision sensors, pressure sensors in combination with acoustic and/or optical sensors, etc.) to produce the effect of safe operation and NOx reduction.

Reference will now be made to various aspects of the present application in view of the definitions above. In addition, it is to be understood that the terms "stability" or "instability" can be used interchangeably and describe the same desired function for a "flame stability sensor" as described herein.

One aspect of the present application provides a method of operating a combustion device (e.g., a furnace, a boiler, etc.) that results in a safe operation and a reduction in NOx emissions The method includes providing a flow of fuel and diluent at a determined volume ratio to a flame in the combustion device, providing a flame stability sensor to generate a measurement of a characteristic of the flame that varies as a function of flame stability, and controlling the determined volume ratio of fuel:diluent as constrained by at least one of (i) a threshold value from one or more measurements from one or more flame stability sensors and (ii) a threshold volume ratio of fuel:diluent as measured from at least one flow sensor on each of the fuel source and diluent source in the flow system.

The diluent generally is a substance that is inert and is not flammable and is not an oxidizing element or agent. Examples of suitable diluents include one or more of the following substances, nitrogen, steam (e.g., superheated steam), carbon dioxide, recycled combustion gas or a combination thereof. In one embodiment, the diluent comprises at least 80% by volume of nitrogen. In an alternative embodiment, the diluent component of the volume ratio of fuel:diluent comprises at least 1% by volume of carbon dioxide. In one embodiment, the fluid is selected from one of, or two of, superheated steam, recycled combustion gas and nitrogen.

As noted above, the flame stability sensor generally includes any device configured to provide an indication as to state of stability or instability of a flame or flames and/or the likelihood of a flame or flames to be extinguished or blow-out based on a direct or indirect measured characteristic of a flame or flames. Such characteristics include one or more of: flame ionization, flame shape, flame color, flame intensity, flame mixing patterns, flame composition, flame temperature, smoke associated with the flame, acoustic noise, and/or light emitted from a flame or flames and/or burner tile. The devices include but are not limited to optical sensors, acoustic sensors, and machine vision sensors. For example, but not limitation, the flame stability sensor is an optical sensor, such as an optical sensor that includes a laser. Preferably, the optical sensor employs one or more tunable diode lasers (TDLs) tuned to a pre-selected wavelength or wavelengths in the near-infrared region, such as those wavelengths corresponding to $H_2O$ absorption features. In an another embodiment, the flame stability sensor is an acoustic sensor, such as a pressure sensor. Preferably, the pressure sensor is a differential pressure sensor that is implemented to monitor statistical fluctuations of acoustic noise from a flame or flames within a combustion device. In another embodiment, the flame stability sensor is a machine vision sensor system having at least one camera.

A variety of techniques are suitable to control and/or constrain the volume ratio of fuel:diluent using at least one measurements from one or more flame stability sensors. For example, the process control can include decreasing the volume ratio of fuel:diluent as limited by a predetermined critical flame instability threshold. In one non-limiting embodiment, the flame instability threshold ($F_{Threshold}$) is a predetermined value derived from calculation of a flame stability factor, F, which in this example, is a computed result from the analysis of frequency content in the measured signal of a flame stability sensor via the following equation:

$$F \propto \frac{C \times \sum_{f_l}^{f_h} \left| FT_{t_i}^{t_f}(R) \right|}{\sum_{f_{min}}^{f_{max}} \left| FT_{t_i}^{t_f}(R) \right|} \qquad \text{Equation (1)}$$

Where F is the flame stability factor, also defined as the fraction of frequency content value for equation 1, is determined by the ratio of the sum of frequency content for two specified frequency ranges from a frequency spectrum, $f_l$ to $f_h$ and $f_{min}$ to $f_{max}$, such that $f_{min} \leq f_l \leq f_h \leq f_{max}$. R is a time varying measurement signal from the flame stability sensor system. FT denotes a short-time Fourier transform performed on R from a rolling initial point in time of the measurement, $t_i$, to a rolling final point in time of the measurement, $t_f$, such that $t_i < t_f$. C represents a scalar value that can be used to manipulate the amplitude of F, which can vary functionally as:

$$C \propto \sum_{f_{min}}^{f_{max}} \left| FT_{t_i}^{t_f}(R) \right| \quad \text{Equation (2)}$$

Where the role of C can be used to normalize or scale F or cancel out the function of the denominator defined in Equation 1.

In one non-limiting embodiment, a flame instability threshold ($F_{Threshold}$) is based on the ratio, R, of the demodulated signals from one or more of the TDLs:

$$R \propto 2f/1f \quad \text{Equation (3)}$$

Where 1f and 2f refer to the signals detected at the first and second harmonic, respectively, of the modulation frequency. In one non-limiting example, F is computed as ~0.02 for stable flames using Equation 1, where R follows Equation 3, C=1, $f_l$ and $f_h$ are 1 and 5 Hz, respectively, $f_{min}$ and $f_{max}$ are 1 and 2,000 Hz, respectively, and F is ~1 when the flame approaches LBO.

A flame instability threshold value, $F_{Threshold}$, can be derived via several methods from the measurement output of at least one flame instability sensor. In one non-limiting embodiment, a minimum criterion to define an $F_{Threshold}$ value is based upon three times the standard deviation of the measurement output from the flame stability sensor under stable operating conditions with or without diluent addition. Preferably, the stable operating condition to base the definition of $F_{Threshold}$ is in an operation with diluent addition and comprises at least 10 seconds of measurement data. Alternatively, the minimum $F_{Threshold}$ value is based on six times the standard deviation of the measurement output from at least one flame stability sensor during a stable operation period of the combustion device. In practice, a larger $F_{Threshold}$ may be required to minimize detection of spurious events for a given combustion device. In the example cited above with F~0.02 for a stable flame, an $F_{Threshold}$ of approximately 0.03 could provide a control constraint on the volume ratio of fuel:diluent fed to the flame such that a potentially unsafe condition would be avoided.

In an alternative non-limiting embodiment, an $F_{Threshold}$ value is defined based on the knowledge of the system response over the range of operation from stable to LBO. In the example above, where the stable flame is characterized by F~0.02 and LBO occurs at F~0.10, a value of $F_{Threshold}$ can be chosen between these values to ensure both low NOx emissions and safe operation. In a preferred embodiment of this example, $F_{Threshold}$~0.03-0.05. More generally, if the flame response between stable and LBO operation is normalized on a scale between 1 and 10, with $F_{normalized}$=1 for a stable flame and $F_{normalized}$=10 for LBO, $F_{Threshold}$ is chosen in a preferred embodiment to be between 1.5 and 5 on this normalized scale.

In an alternative non-limiting embodiment, the control of and/or constraint of the volume ratio of fuel:diluent includes adjusting the flow of the fuel from a fuel source and/or adjusting the flow of the diluent from a diluent source. Preferably, the control of the fuel:diluent ratio is performed in real-time and is constrained by a threshold measurement obtained from one or more flame stability sensors (i.e., a $F_{threshold}$ value of 0.03 as measured by a Wavelength Modulated TDL sensor). More preferably, the control of the fuel:diluent ratio is performed in real-time and is to be constrained by (i) a threshold measurement from one or more flame stability sensors and (ii) a threshold volume ratio of fuel:diluent as derived from at least one flow sensor on each of the fuel source and diluent source in the flow system.

In accordance with another aspect of the present application, a combustion system is provided that includes a combustion device (e.g., a furnace, boiler, etc), a fuel source, a diluent source, a flow system in communication with the fuel source and the diluent source to provide a flow of fuel and diluent at a determined volume ratio to a flame in the combustion device, at least one flame stability sensor generates one or more measurements of at least one characteristic of a flame or flames, and at least one controller to control the determined volume ratio of fuel:diluent based upon and/or constrained by at least one threshold value from one or more measurements from one or more flame stability sensors and/or a threshold volume ratio of fuel:diluent as measured by at least one flow measurement from each of the fuel source and the diluent source. The combustion system in accordance with the present invention provides safe, reliable and stable operation of the flame while reducing NOx emission from the combustion system.

As with the method described above, the flame stability sensor or sensors employed in the combustion system can be, for purpose of illustration and not limitation, an optical sensor operating at a preselected wavelength or wavelengths, including ultraviolet, visible, and infrared (i.e., near-, mid-, or far-), corresponding to a spectroscopic absorption feature derived from any characteristic product from the full, partial, or incomplete combustion of a fuel and/or from any component or components present in the fuel or diluent supplied to a flame in the combustion device that can be used to derive, either directly or indirectly, a measure of flame stability or instability. Preferably, the optical sensor includes a laser, such as a wavelength modulated tunable diode laser (TDL) sensor system tuned to a pre-selected wavelength or wavelengths. In a preferred embodiment, the pre-selected wavelength or wavelengths are in the near-infrared region. More preferably, the pre-selected wavelength or wavelengths are between about 1349 nm to about 1395 nm. Alternatively, the preselected wavelengths are about 1.4 μm.

The diluents used in the combustion system are as described above. Preferably, the controller in the combustion system provides real-time control using a threshold measurement from at least one flame stability sensor. In one embodiment, the controller decreases the volume ratio of fuel:diluent as limited by a predetermined critical flame instability threshold, $F_{Threshold}$. In one non-limiting embodiment, which employs a wavelength modulated tunable diode laser sensor, the predetermined critical flame instability threshold corresponds up to about 0.06 as derived from fluctuations in $H_2O$ absorption characteristic to flame instability between 1 to 5 Hz.

Particular aspects of the method and system are described further below for purpose of illustration, and not limitation.

Fuel:Diluent Ratios and Operational Considerations for Combustion Devices

As noted above, the term "diluent" generally includes fluids that are not flammable (or in one embodiment, substantially not flammable) and are not oxidizing elements or agents, but specifically do not include air. Therefore, fuel:diluent volume ratios do not include the amount of air that is included in the feed to the flame in the combustion device. A person of ordinary skill in the art can determine an initial fuel:diluent ratio, based on, for example, the combustion device used and the nature of the fuel used in the combustion device, and amount of air included in the feed to the flame.

For example, and in accordance with one embodiment of the present application, the volume of diluent fed to the flame is about 1% to about 50% of the volume of fuel fed to the flame (excluding air). Accordingly, in one particular embodiment, the fuel:diluent volume ratio can range from about 2 to about 100. More preferably, the volume of diluent fed to the flame is about 10% to about 40% of the volume of fuel fed to the flame, thus the fuel:diluent volume ratio can range from about 2.5 to about 10. Even more preferably, the volume of diluent fed to the flame is about 20% to about 30% of the volume of fuel fed to the flame, thus the fuel:diluent volume ratio can range from about 2.5 to about 3.33.

In operating a combustion device using the methods of the present application, the initial fuel:diluent ratio can be set such that the entire stream ultimately fed to a flame results in a relatively stable feed, thus operating far away from the lean blowout (LBO) limit. Thus, for example, the fuel:diluent ratio can initially be set relatively high (e.g., around 100), or alternatively there can be no initial diluent flow to the flame. The combustion device operating under such conditions can provide a stable flame assuming appropriate oxidizer flow, yet such operation is also likely to provide high flame temperatures and higher NOx emissions. The stability of the flame and the temperature depend on the fuel/air ratio.

Once flame stability has been assured, the amount of diluent fed to the flame can be increased (or the amount of fuel fed to the flame can be decreased) in order to move closer to the LBO limit for a combustion device. Although it is desirable, from a NOx emission standpoint, to operate as close as possible to the LBO limit, practically there should be a margin of error to ensure that the LBO limit is not actually reached to provide safe operation. In order to provide a safe operating margin, a "flame instability threshold" from one or more flame stability sensors can be established based on the LBO limit, which can be determined empirically, and the minimum acceptable cushion for safe operation of the combustion device can be defined so as to avoid unsafe conditions such as flame blowouts. More preferably, a safe operating margin is additionally ensured with constraint on the volume ratio of fuel:diluent fed to a flame, such that under normal operation the volume ratio of fuel:diluent cannot exceed a value (i.e., less than about 1 to about 2) where the flame instability threshold value from the flame stability sensor would be reached.

In one embodiment of the present invention, the fuel:diluent ratio is initially set relatively high and then lowered until, based on the output of one or more flame stability sensors, the flame instability threshold is approached. Preferably, the adjustment and/or constraint of the fuel:diluent ratio is based on a real-time measurement of flame stability. Once the fuel:diluent ratio is such that the flame stability threshold is exceeded (i.e., the flame is operating too close to the LBO limit), then the fuel:diluent ratio can be increased so as to provide a safe operating margin.

In another embodiment of the present invention, the fuel:diluent ratio is initially set relatively high and then lowered as to approach the LBO limit until, based upon flow measurements from the flow system (i.e., at least one flow measurement from the fuel source and at least one flow measurement from the diluent source), a predetermined threshold for the volume ratio of fuel:diluent is obtained such that the LBO limit is not actually reached. Preferably, the adjustment and/or constraint of the volume ratio of fuel:diluent is based on real-time measurements from the flow system that is constrained by a threshold volume ratio of fuel:diluent as well as an additional constraint based on a flame instability threshold from at least one real-time measurement by a flame stability sensor. If either the flame instability threshold or the threshold volume ratio of fuel:diluent is exceeded (i.e., the flame is operating too close to the LBO limit), then the fuel:diluent ratio should be increased so as to return the combustion device to a safe operating margin.

Diluent Feed Streams

The diluent feed to the flame of the combustion device can be introduced in a separate dedicated stream, or can be combined with the fuel/air stream prior to introduction to the flame. Furthermore, the diluent stream can consist of more than one component (e.g., a mixture of superheated steam and recycled combustion gas).

A preferred diluent in the present application is steam, more preferably superheated steam. A second preferred diluent is recycled combustion gas, which consists largely of nitrogen, carbon dioxide, and water vapor.

Flame Stability Sensors

A variety of technologies currently exist or could be developed by those skilled in the art to generate a measure of flame stability, flame instability, and/or the likelihood of LBO from a flame within a combustion device derived from the direct and/or indirect measure of one or more flame characteristics. As used herein, a flame stability sensor or flame stability sensor system is used to generate a measure of flame stability, flame instability, and/or the likelihood of LBO through direct and/or indirect interrogation of one or more flame characteristics. For purposes of this application, any measure of flame instability or indication as to the likelihood of LBO derived from such a device or series of devices for the purpose of monitoring, controlling, constraining, and/or optimizing a method or system for reduction of NOx emissions in fired heaters with the addition of a diluent to fuel falls within scope of this application, including the implementation of at least one of any type of flame stability sensor. Current technologies applicable as flame stability sensors include optical sensors (i.e., laser-based sensors), acoustic sensors (i.e., pressure sensors), and machine vision sensor systems (i.e., a system comprising a camera to generate an optical image).

Preferably, flame stability sensors in the present application are laser-based optical sensor systems employing at least one TDL, an acoustic-based sensor system comprising at least one pressure sensor, and a machine vision sensor system consisting of at least one camera, more preferably a high-temperature furnace camera. The sensors may be used alone or in combination (e.g., optical sensor with acoustic-based sensor and/or machine vision sensor). Regardless of the sensor type, data processing can be performed on a processing component within a field mounted sensing device and/or an independent electrical component common to one or more sensing devices, with or without direct communication to the one or more sensing devices, and be located either in the field or in an enclosure (i.e., an analyzer shelter, control room, etc.). Any combination of two or more flame stability sensor types or sensor systems also falls within scope of this application (i.e., one of a laser optical sensor system and two of machine vision sensor systems, etc).

In general, changes in signal from flame stability sensors result from a change in at least one flame characteristic over time. The change in a flame characteristic or flame stability sensor signal over time can be characterized in the frequency domain by performing a Fourier transform on the sensor output prior to further alteration over a specified amount of sampling time (i.e., 10 seconds). The available frequency information contained within an output for a given sensor type is limited to one half of the device sampling rate. Thus, a frequency range or subset of frequency ranges can be defined that contains a sufficient amount of information useful in the measure of flame stability and/or flame instability. For example but not limitation, a pressure sensor that records data at 22 Hz can resolve pressure fluctuations up to 11 Hz. A Fourier transform on 10 seconds of pressure data reveals that pressure fluctuations characteristic to flame instability occur in the range of 1-10 Hz for a given sensor type, combustion system, and combustion device. Thus, either a select portion of the signal in the frequency domain (i.e., 1-5 Hz or 2-8 Hz, etc) or all data from the signal in the time domain from the pressure sensor can be used to measure stability, instability, and/or likelihood of LBO. In practice, the portion or portions of data generated by a flame stability sensor useful for flame instability detection contained within the output signal, regardless of sensor type, flame source, combustion device, and/or combustion system can be determined as set forth. In addition, as in the case with the pressure sensor, either all sensor data or a select portion of sensor data may be used to measure flame stability provided an adequate measurement can be generated for the given combustion system.

A variety of computation methods currently exist or could be developed by those skilled in the art to generate a value and/or set of values with correlation to flame stability, flame instability, and/or the likelihood of LBO, denoted herein as a flame stability factor, F, that is derived from one or more outputs from one or more flame stability sensors, described above. A preferred non-limiting example of such a computation method has been described above in Equation (1) and accompanying text. Other preferred computation methods include computation of statistical variables (i.e., standard deviation, variance, etc.) on the measured outputs of flame stability sensors. Regardless of computation method, a hardware and/or software based filtering method or methods (i.e. high-pass filter) and/or a data averaging method or methods may be incorporated as part of the computation of a flame stability factor. Within spirit of this application, a flame stability factor relates to any information or value derived from at least one measured signal or any combination of measured signals obtained by one or more flame stability sensors, regardless of type, that could be used as the basis for a control action, either manually or automatically, for controlling, optimizing, and or constraining the volume ratio of fuel:diluent and/or mitigation of flame instability via any method to increase the volume ratio of fuel:diluent, including the removal of diluent from the stream fed to the combustion device.

Optical Sensors

As used herein, the term optical sensors refers to any sensor that transmits, receives or otherwise uses light or a light source (e.g., a light emitting diode (LED), TDL, globar, and quantum cascade laser (QCL)) to ascertain qualities or characteristics of a flame that are indicative of and/or correlated to flame stability, flame instability, and/or the likelihood of LBO. Such optical sensors are not limited to those that transmit, receive or use near-infrared light, as optical flame sensors, as used in the present application, and includes sensors that transmit, receive or otherwise light in the infrared (IR), visible (VIS), Ultraviolet (UV), or any combination of UV, VIS, and IR radiation.

As disclosed in U.S. Pat. No. 7,019,306, which is hereby incorporated by reference in its entirety, a UV flame sensor typically detects radiation emitted in the 200 to 400 nm range. Optical sensing devices incorporating a UV detector to sense the presence of the augmentor flame in gas turbine engines sense UV radiation emitted from the augmentor flame against the background of hot metal, in a high temperature environment and under heavy vibration.

Other non-limiting examples of optical sensors that can be used in accordance with the methods and systems of the present invention include, but are not limited to, the sensors described in U.S. Pat. Nos. 7,334,413, 6,127,932 4,709,155 and 3,689,773 each of which are incorporated by reference in their entirety.

A preferred but non-limiting optical sensor to ascertain flame stability that can be used in the methods of the present application include flame stability sensors that employ a laser. As used herein, the term laser refers to a coherent and/or collimated beam of light at a defined wavelength or wavelength range. A preferred type of optical sensor that includes a laser is a wavelength modulated tunable diode laser sensor, which is described below for purposes of illustration, but not limitation.

Wavelength Modulated Tunable Diode Laser (TDL) Sensors

In an embodiment of the present application, a tunable diode laser sensor is employed to determine gas temperature based on measuring line-of-sight (LOS) water vapor absorption, whose time dependence in turn provides a measure for establishing flame stability. Nonintrusive wavelength-multiplexed temperature measurements based on two or more water vapor absorptions can be employed, whereby such absorptions can be from two neighboring or non-neighboring near-infrared (NIR) transitions of water vapor. Commercially available telecommunication fiber-coupled tunable diode lasers and optical components can be employed in TDL sensors. Such techniques can be employed successfully in part because $H_2O$ is an optically absorbing combustion product of hydrocarbon fuels. In an alternative nonlimiting embodiment, a wavelength modulated tunable diode laser, with or without wavelength-multiplexing, can be used as a flame stability sensor for the measurement and evaluation of any wavelength in the near-infrared region corresponding to a spectroscopic absorption feature derived from any characteristic product from the full, partial, or incomplete combustion of a fuel source or from any components present in the fuel or diluent supplied to a flame in a combustion device (i.e., furnace or boiler), including any optically active component in the near-infrared either intentionally or unintentionally added to the fuel or diluent source.

A non-limiting example of such a sensor that can be employed in the methods and systems of the present invention include the sensors described by Li et al. of Stanford University and published in the AIAA Journal, Vol. 45, No. 2, February 2007, pp. 390-398, which is hereby incorporated by reference in its entirety. One sensor described by Li et al. is based on nonintrusive measurements of gas temperature using combined wavelength-modulation spectroscopy (WMS) and 2f detection that target a $H_2O$ line pair near around 1.4 μm. It is noted, however, that temperature changes, particularly temperature changes in the hottest region of the burned gas, are more important than the absolute value of the determined temperature. For additional details, see Zhou et al., "Development of a Fast Temperature Sensor for Combustion Gases Using a Single Tunable Diode Laser," Applied Physics B (Lasers and Optics), Vol. 81, No. 5, 2005, pp. 711-722, which is hereby incorporated by reference in its entirety.

In another non-limiting embodiment, the flame stability sensor employs three diode lasers tuned to $3H_2O$ absorption wavelengths (e.g., 1349 nm, 1376 nm and 1395 nm). The $3H_2O$ absorption features with different temperature sensitivities enable the probing of temperature fluctuations and other flame characteristics that may fluctuate within the flame (e.g. flame shape). Wavelength modulation spectroscopy is performed (1f-normalized, WMS-2f) using 1 frequency-multiplexed detector with up to 3 MHz bandwidth (4 kHz data rate). A schematic of the sensor system 30 is set forth in FIG. 1. In one non-limiting embodiment, a single laser can be used for one or more LOS measurements through a flame or flames inside a combustion device. The present invention is not intended to be limited to the use of a single laser; rather, one or more lasers are considered to be well within the scope of the present invention. Furthermore, a measure of flame stability derived from employing one or more laser sensors targeting a single absorption band (i.e., $H_2O$) is within scope of the present invention.

In one embodiment of the present application, the "flame instability threshold" based on output from a Wavelength-Multiplexed, Wavelength Modulated Tunable Diode Laser (TDL) Sensor is established. The flame instability threshold is primarily based on the temperature fluctuations within the LOS (line-of-sight), which includes fluctuations of flame shape that may cause the flame to stray outside of the LOS. In one non-limiting embodiment, when fluctuations in sensor signal occur in a particular frequency range characteristic to flame instability (e.g., 1-5 Hz) constituting a fraction of frequency content, F, that is greater than a given threshold (e.g., greater than 0.02, or greater than 0.03 or greater than 0.06) then the flame instability threshold, $F_{Threshold}$, has been reached. Such fluctuations in the sensor signal can correspond to one or any combination of fluctuations within the flame characteristics. More particularly, in one embodiment when F, as that value is determined as set forth above, is greater than, for example, 0.02 then the $F_{Threshold}$ has been reached and the volume ratio of fuel:diluent should be increased.

Figure 2:
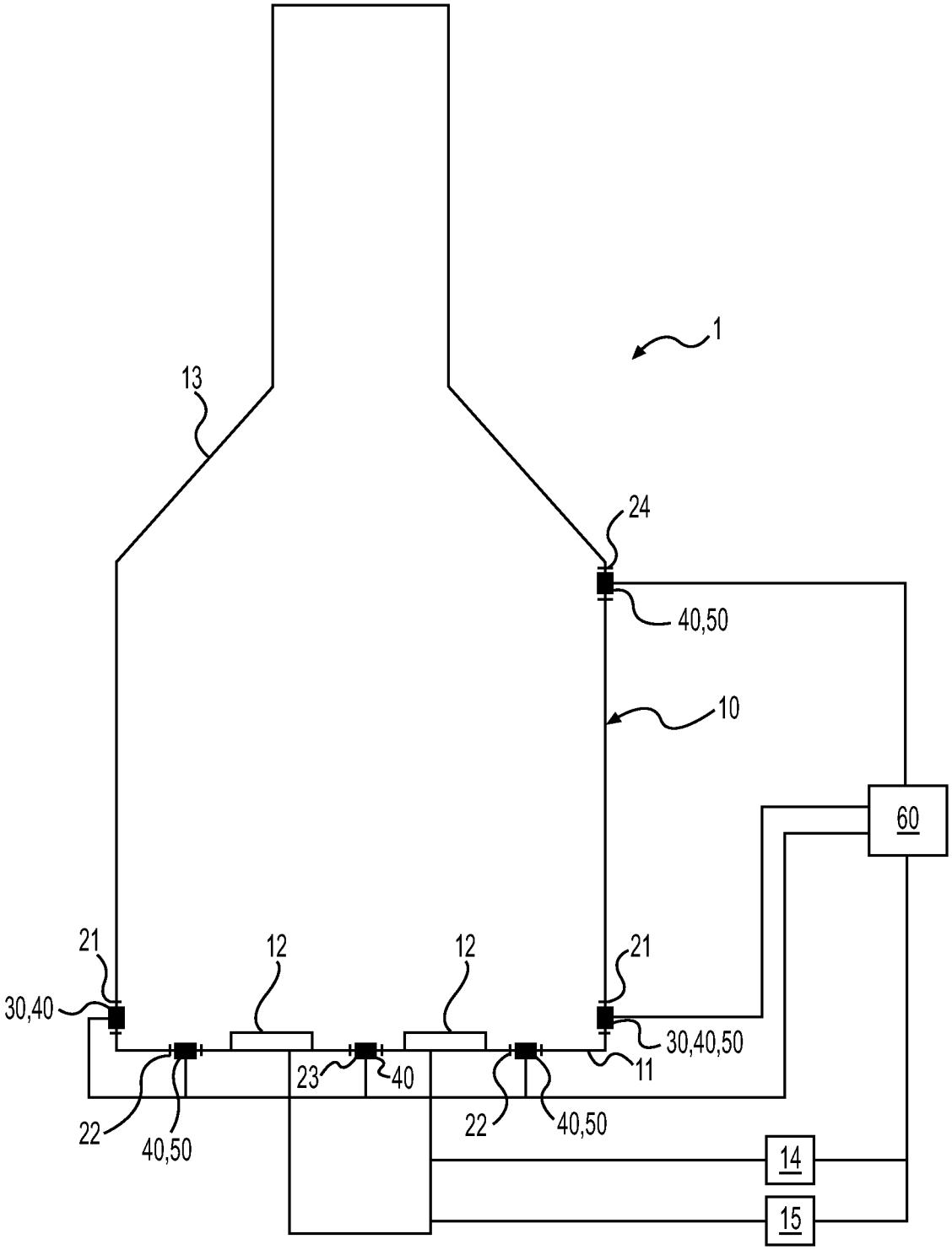
FIG. 2 provides a non-limiting example of a combustion device that depicts different preferred tap locations for various flame stability sensor types.

The present invention will now be described in greater detail in connection with FIG. 2. FIG. 2 is a schematic diagram of a combustion device 1 in accordance with the present invention. The combustion device 1 includes a housing 10 having a burn plate 11. At least one flame source 12 is located on the burn plate 11. The flame source 12 is operatively connected to a fuel gas source 14 and a diluent source 15. The fuel gas and diluent may be individually fed to the flame source 12 or combined and fed as a single stream to the flame source 12. The housing 10 further includes a bridgewall 13. In accordance with the present invention, the housing 10 includes at least one tap hole through which a sensor may be located in order to sense and measure the flame characteristic of the combustion device 1. One or more tap holes 21 may located in the combustion device 1 near the flame source 12. The tap holes 21 are preferably located a point just above the burn plate 11 and the flame sources 12. Tap holes 22 and 23 may be located in the burn plate 11 in close proximity to the flame sources 12. At least one tap hole 24 may be provided in housing 10 in close proximity to the bridgewall 13. It is contemplated that the present invention is not intended to limited to these locations; rather it is contemplated that other locations are considered to be well within the scope of the present invention, including but not limited to spaced locations along the wall of the combustion device 1 between the burn plate 11 and the bridgewall 13. The present invention utilizes one or more of the following flame stability sensor systems 30, 40, 50, either alone or in combination: optical sensor system 30, acoustic sensor system 40, and a machine vision sensor system 50. The systems are operatively coupled to a controller 60, as shown in FIG. 2, which receives the sensed output from the systems 30, 40, 50 and performs the necessary determinations regarding flame stability and any necessary corrections to the diluent:fuel ratio to establish and maintain safe flame characteristic. The controller 60 may control either directly or indirectly the operation of the supplies 14 and 15 to provide the necessary diluent:fuel ratio.

In accordance with one embodiment of the present invention utilizing an optical sensor system 30. At least one optical sensor system 30 is located in the tap hole 21. The use of the tap holes 21 allows transmission and receiving of optical energy from the sensor system that has passed through a flame or flames at least one time just above the flame source 12 in order to measure of the flame characteristic within the combustion device 1. Preferably, the combustion device 1 includes more than one flame source 12. With such an arrangement, the tap holes 21 are located such that the optical energy transmitted and received by the optical sensor systems 30 pass through one or more flames from the flame sources 12. It is contemplated that the optical energy from the sensor system 30 can be emitted from a single tap hole 21 and received by the sensor system 30 located in another tap hole 21. It is also contemplated the optical sensor system 30 both transmit and receive optical energy from a single tap hole 21 following at least one reflection of an optical beam. Information from the sensor system 30 is transmitted to the controller 60 to determine the fuel:diluent ration described above and recommend and/or implement and modifications to the ratio (i.e., modify fuel supply and/or diluent supply) to maintain a stable flame characteristic.

Acoustic Sensors

In accordance with another aspect of the present invention, an acoustic sensor system 40 may be used to ascertain at least one flame characteristic. As used herein, the term acoustic sensor refers to any sensor that transmits, receives or otherwise uses an acoustic source (e.g., a pressure sensor, microphone, accelerometer, cantilever, etc.) to ascertain at least one characteristic of a flame or flames, directly or indirectly, that is indicative of flame stability, flame instability, and/or the likelihood of LBO. Such acoustic sensors are not limited to those that transmit, receive or use acoustics, such as the pressure sensor described in the present application, and includes sensors that transmit, receive or otherwise acoustic signals.

A preferred but non-limiting type of acoustic sensor to ascertain the state of flame stability and/or instability that can be used in the methods of the present application include flame stability sensors that employ a pressure sensor. As used herein, the term pressure sensor refers to a device used for the purpose of measuring pressure inside the combustion device. A preferred type of pressure sensor is a differential pressure sensor, which is described below for purposes of illustration, but not limitation.

A differential pressure sensor 40 is employed to measure draft in a combustion device 1, whose time dependence in turn provides a measure for establishing flame stability and/or instability. Flame stability measurements based on one or more pressure sensors can be employed, whereby detectable changes in acoustic signal arise near the onset of flame instability and/or LBO. Commercially available pressure sensors with statistical analysis packages, including those with differential, gauge, or absolute measurement outputs, can be employed as an acoustic-based flame stability sensor. Such techniques can be employed successfully in part because statistical analysis of acoustics within the combustion device measured by the sensor, typically at rates ≥16 Hz, can be used to compute identifiable and actionable characteristics of both stable and unstable conditions of a flame or flames. In an alternative embodiment, a differential pressure sensor without a statistical analysis package can be employed as a flame stability sensor; whereby, statistical analysis and/or other data analysis methods can be implemented on an independent electronic device to derive a measure of flame stability or flame instability based on an output from the sensing device.

A "flame instability threshold" may be established based on the filtered, averaged, and normalized output of draft from five differential pressure sensors. The flame instability threshold is primarily based on pressure fluctuations within the combustion device relative 1 to atmospheric pressure. When fluctuations in sensor signal occur constituting a change in a statistical parameter (i.e., variance) that is greater than a given threshold (e.g., greater than 0.1, or greater 0.12, or greater than 0.2), then the flame instability threshold, $F_{Threshold}$, has been reached. Such fluctuations in the pressure sensor signal are derived from a measure of at least one flame characteristic, either directly or indirectly, that originates within the combustion device. More particularly, in one embodiment when the filtered, averaged, and normalized variance of the measured draft is greater than, for example, 0.12 then the $F_{Threshold}$ has been reached and the volume ratio of fuel:diluent should be increased.

Alternatively, a "flame instability threshold" may be established based on output from a differential pressure sensor. The flame instability threshold is primarily based on pressure fluctuations within the combustion device. When fluctuations in sensor signal occur in a particular frequency range characteristic to flame instability (e.g., 2-5 Hz or 2-10 Hz) constituting a change in a statistical parameter (i.e., standard deviation) from the sum of magnitudes over a defined range in the acoustic frequency spectrum that is greater than a given threshold (e.g., greater than 0.05 or greater than 5) then the flame instability threshold, $F_{Threshold}$, has been reached. When the standard deviation of the acoustic frequency spectrum is summed from 2-10 Hz following calculation of a short-time fast Fourier transform for 10 seconds of previously measured pressure data, is greater than, for example, 0.05 then the $F_{Threshold}$ has been reached and the volume ratio of fuel:diluent should be increased.

With reference to FIG. 2, the pressure differential sensors 40 are located in at least one tap hole 21, 22, 23, 24 allowing measurement of an acoustic signal from within the combustion device. The sensor system 40 may be located in close proximity to a flame source 12 in tap holes 21. The sensor system 40 may be located in a tap hole 24 in close proximity to the bridgewall 13. The sensor system 40 may be located in a tap hole 23 on the burner plate 11 at a location equidistant from multiple flame sources 12 or within closer proximity to one flame source at a tap hole 22. In accordance with the present invention, any number of combinations of tap holes 21, 22, 23 and 24 may be utilized for the differential pressure sensor system 40. Information from the sensor system 40 is transmitted to the controller 60 to determine the fuel:diluent ratios described above and recommend and/or implement and modifications to the ratio (i.e., modify fuel supply and/or diluent supply) to maintain a stable flame characteristic.

Machine Vision Sensor System

In accordance with another aspect of the present invention, a machine vision sensor system 50 may be used to ascertain at least one flame characteristic. As used herein, the term machine vision sensor system 50 refers to any sensor system that transmits, receives or otherwise uses an optical image (e.g., a video camera, etc.) to ascertain at least one characteristic of a flame or flames, directly or indirectly, that is indicative of flame stability, flame instability, and/or the likelihood of LBO within a combustion device. Such machine vision systems 50 are not limited to those that transmit, receive or use visible (VIS) light, to generate optical images for flame sensing, as used in the present application, and includes sensor systems that transmit, receive or otherwise optical images comprised of light in the near-infrared (NIR), infrared (IR), Ultraviolet (UV), or any combination of UV, VIS, NIR, and IR radiation.

Preferably, the machine vision sensor system includes a flame stability sensor systems that employ a camera. As used herein, the term camera refers to a device used for the purpose of obtaining an optical image from inside the combustion device comprised of light. A preferred type of camera is a high-temperature furnace camera operating in the visible radiation spectrum, which is described below for purposes of illustration, but not limitation.

Preferably, the machine vision sensor system 50 utilizes a high-temperature furnace camera to obtain an optical image from within a combustion device 1, whose output in turn provides a means for establishing flame stability, flame instability, and/or the likelihood of LBO. The machine vision sensor system 50 may utilize one or more cameras, whereby detectable changes in an optical image or images arise at or near the onset of flame instability and/or LBO. Commercially available high-temperature furnace cameras can be employed as part of a machine vision based flame stability sensor system 50. Machine vision sensor systems are also typically comprised of a central processing unit 60 with a visual display unit, an image analysis package, or both. Such systems can be employed successfully in part because flame intensity, or light intensity, within the combustion device can be measured by the sensor system, directly or indirectly, and exhibit identifiable and actionable characteristics of both stable and unstable flame states, as well as indication to the approach of LBO.

In a preferred embodiment, a machine vision system 50 comprised of a high-temperature furnace camera positioned in or near the tap hole, a central processing unit or controller 60 which contains an image analysis package and performs statistical analysis. The controller 60 derives a measure of flame stability, instability, and/or likelihood of LBO based on one or more outputs from the analysis of an optical image obtained by the camera. The controller 60 can then determine the fuel:diluent ratios described above and recommend and/or implement and modifications to the ratio (i.e., modify fuel supply and/or diluent supply) to maintain a stable flame characteristic.

In accordance with one aspect of the present invention, the "flame instability threshold" is determined by the controller 60 based on an average of more than one time dependant outputs from analysis of optical images obtained and analyzed by a machine vision sensor system employing a high-temperature furnace camera. The flame instability threshold is primarily based on light intensity fluctuations from flames within a combustion device captured in a series of optical images and analyzed by the machine vision sensor system. When fluctuations in sensor signal (e.g., light intensity in selected portions of an optical image) occur constituting a change in a statistical parameter (i.e., variance) that is greater than a given threshold (e.g., greater than 0.002, or greater 0.2, or greater than 1) then the flame instability threshold, $F_{Threshold}$, has been reached. Such fluctuations in the sensor signal are derived from a measure of at least one flame characteristic, directly or indirectly, that originates within the combustion device 1. When the variance of the measured optical intensity within a portion of the optical image is greater than, for example, 0.002 then the $F_{Threshold}$ has been reached and the volume ratio of fuel:diluent should be increased.

In accordance with another aspect of the present invention, a "flame instability threshold" is based on the time dependant average of a predetermined number of outputs from analysis of optical images obtained from the system 50, which is analyzed by the controller 60. The flame instability threshold is primarily based on the magnitude of optical intensity fluctuations from flames within the combustion device. When a decrease in sensor signal occurs characteristic to the approach of flame instability or LBO (e.g., from 50 to 20 or 60 to 25 or 100 to 30) constituting a change in the optical intensity measurement (i.e., decrease in light intensity) from analysis of optical images less than a given threshold (e.g., less than 20 or less than 25) then the flame stability threshold, $F_{Threshold}$, has been reached. When the average intensity value from an average of thirteen outputs from a machine vision sensor system is less than, for example, 25 then the $F_{Threshold}$ has been reached and the volume ratio of fuel:diluent should be increased.

In accordance with yet another aspect of the present invention, two "flame instability thresholds" based on the average of time dependant outputs from analysis of both overall intensity and intensity fluctuations from optical images obtained from the system 50 and are analyzed by the controller 60. The flame instability thresholds are based on the same principles as set forth in preceding paragraphs. Such techniques are successful in part as the machine vision sensor system has the capability to execute one or more analysis methods on one or more portions of optical images obtained by the camera. As such, when the $F_{Threshold}$ has been reached for either analysis methods, an $F_{Threshold}$ for that system has been reached and the volume ratio of fuel:diluent should be increased.

In accordance with an aspect of the invention utilizing sensor system 50, optical images from within the combustion device 1 may be captured at any one of tap holes 21, 22 and 24 by a camera. The optical images are preferably obtained from locations offering the most clear unobstructed view of the flame(s). Preferably, the images are obtained by tap holes 21 or 22. Even more preferably, one or more tap holes 24 would be utilized to obtain the images. The present invention is not intended to be limited to a single tap hole location; rather, any combination or location of tap holes is contemplated to be well within the scope of the present invention.

In a preferred embodiment of the present application, a select portion or portions of an optical image captured by a machine vision sensor system 50 are utilized and processed by the controller 60 to derive a measure of flame stability, instability, and/or likelihood of LBO. More preferably, a select portion or portions of an optical image can be utilized for analysis that provides a characteristic measure for a specific flame source within a combustion device, particularly in multi-flame source combustion devices. Even more preferably, an optical image can be broken down into six portions for analysis of each respective flame source fully viewed by a camera. The six portions include one set of two complimentary sections that encompass two halves of the flame source, one set of two complimentary sections that encompass two halves of the flame source rotated 90 degrees with respect to two halves selected in the first set, one portion that is circumscribed by the inner diameter of the flame source, and one portion that circumscribes the outer diameter of the flame source. In preferred non-limiting embodiments, one or more portions, including any and all combinations thereof, of the optical image can be utilized for analysis with the machine vision sensor system to generate a flame stability signal to be used in the methods set forth in the present application.

EXAMPLES

The present application is further described by means of the examples, presented below. The use of such examples is illustrative only and in no way limits the scope and meaning of the invention or of any exemplified term. Likewise, this application is not limited to any particular preferred embodiments described herein. Indeed, many modifications and variations of the invention will be apparent to those skilled in the art upon reading this specification. The invention is to be understood by the terms of the appended claims along with the full scope of equivalents to which the claims are entitled.

Example 1

Figure 3:
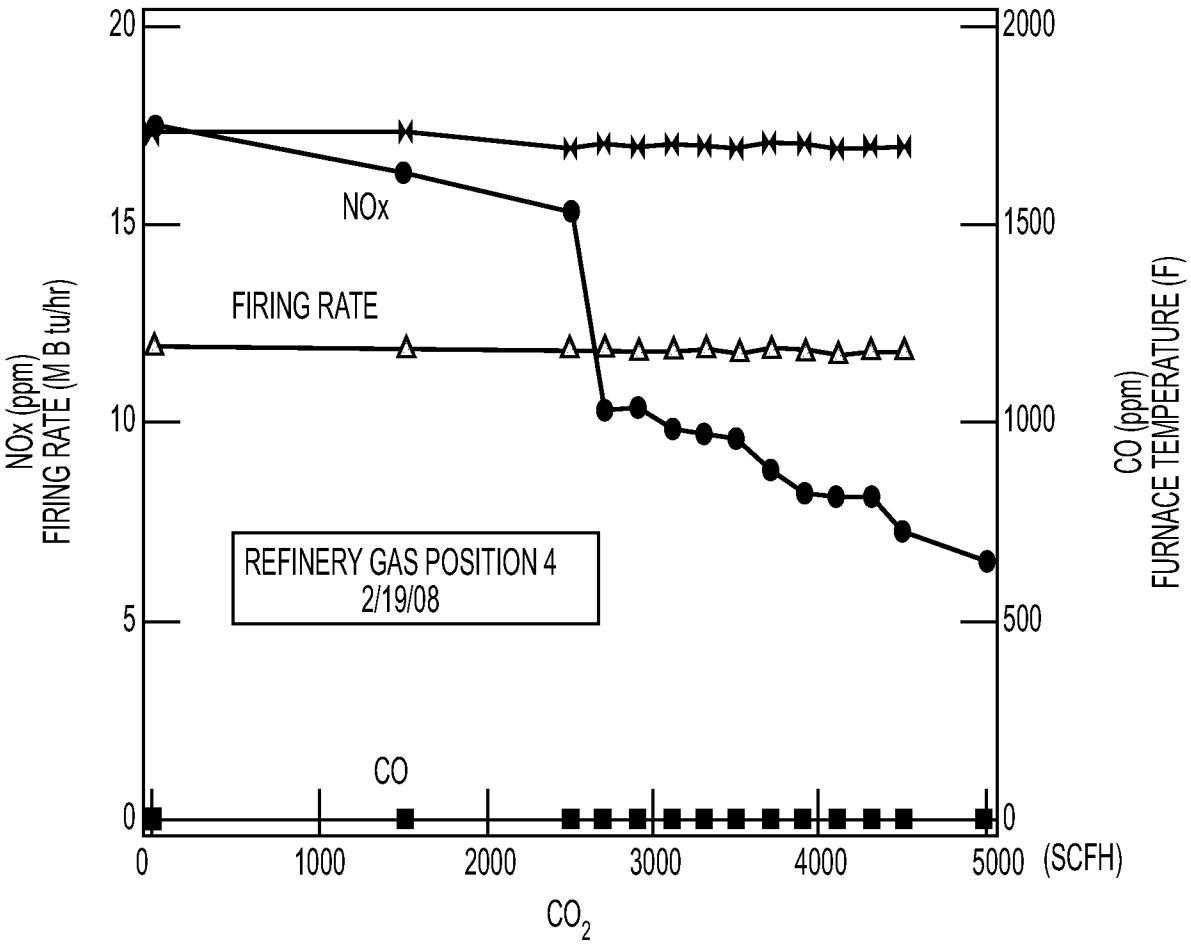
FIG. 3 shows the results of CO and NOx emissions of a combustion device, as increasing amounts of the diluent carbon dioxide is fed to the flame.

Refinery gas (e.g., typically containing $CH_4$, $C_3H_8$, $H_2$ and $CO_2$) and Tulsa natural gas was supplied to a single commercial grade Ultra Low NOx Burner at a firing rate of about 11 MBTU/hr and 7 MBTU/Hr for the refinery gas and 7 MBTU/hr for the Natural Gas. Flame stability was measured with a Wavelength-Multiplexed, Wavelength Modulated Tunable Diode Laser (TDL) Sensor based on the protocol set forth above. Carbon dioxide at ambient conditions was added to the fuel to simulate the addition of recycled combustion gas. During the tests, between 0 and 5000 SCFH (standard cubic feet per hour) of $CO_2$ was added, as illustrated in FIG. 3. CO (ppm) and NOx (ppm) emissions were determined and the results are set forth in FIG. 3. The emissions were obtained from sensors located in the flue stack. As shown in FIG. 3, NOx emissions decreased as the amount of carbon dioxide is increased. 3-fold $NO_x$ reductions can be achieved upon addition of diluent.

Figure 4A:
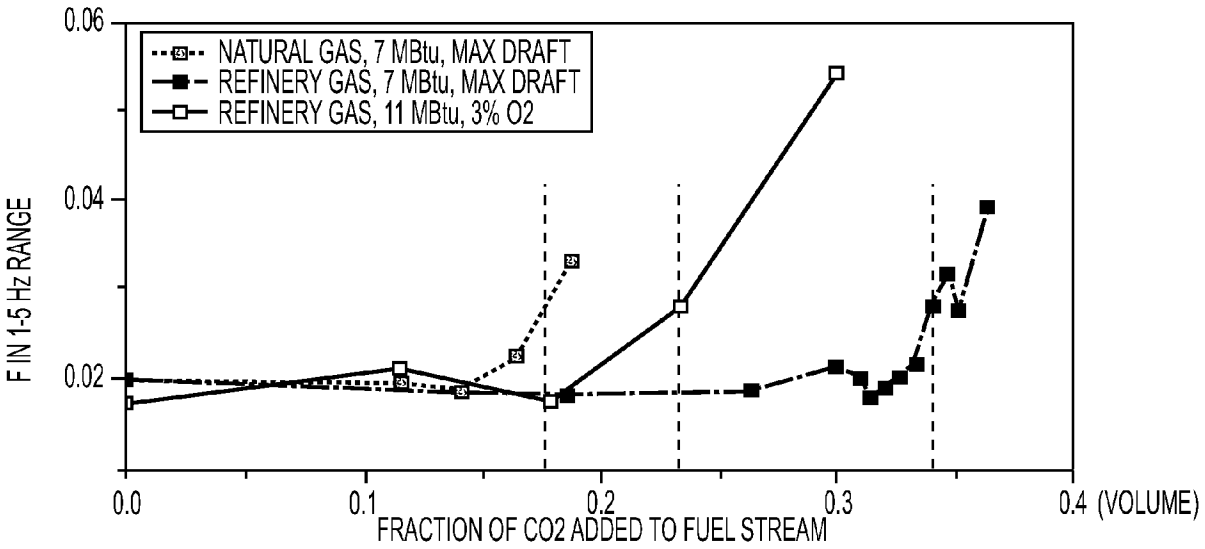
FIGS. 4A and 4B plots the amount of NOx emission and the instability output, F, based on the fraction of $CO_2$ added to the fuel stream. The instability output, F, is derived from the TDL Sensor described in FIG. 1.
Figure 4B:
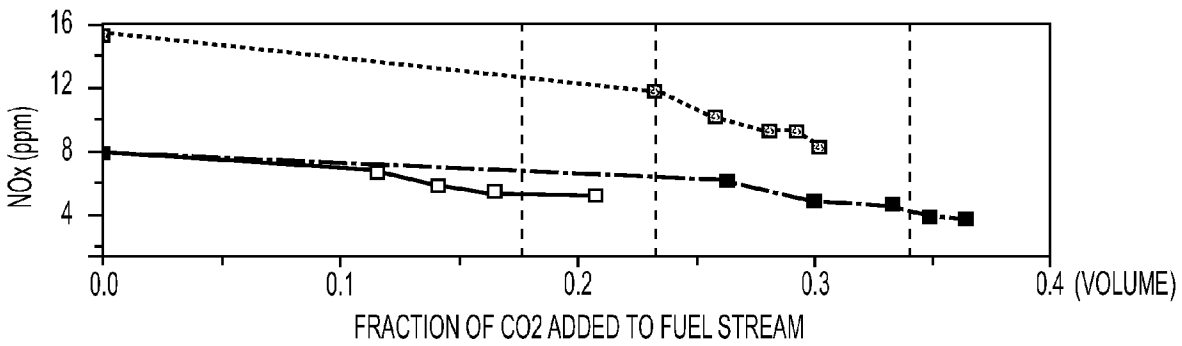

Based on results from this example, NOx emissions and the "F" value of the flame sensor, as determined based on the protocol set forth above, was plotted against the fraction of $CO_2$ in FIGS. 4A and 4B, where the $CO_2$ gradually increased as a fraction of the fuel. Some air is fed to the flame as an oxidant. The results in FIGS. 4A and 4B show that the highest $CO_2$ addition levels correspond to the greatest reduction in NOx and to the greatest instability signal (F). This demonstrates a strategy whereby a critical instability threshold can be defined and this signal can be used in a feedback control strategy to limit the diluent flow to the burner in order to maintain stable operation while achieving the lowest possible NOx emissions.

Flame instability accompanies NOx reduction, and this instability is caused by the increase use of diluent. It is possible to identify a critical threshold value of F, $F_{threshold}$, that identifies unstable operation well before blow-out or extinction occurs, particularly, for example, in embodiments employing real-time feed back or feed forward control based on use of a sensor described in this example using at least one wavelength to determine flame instability, or a sensor encompassed by any of the claims of the present application.

Example 2

Figure 5:
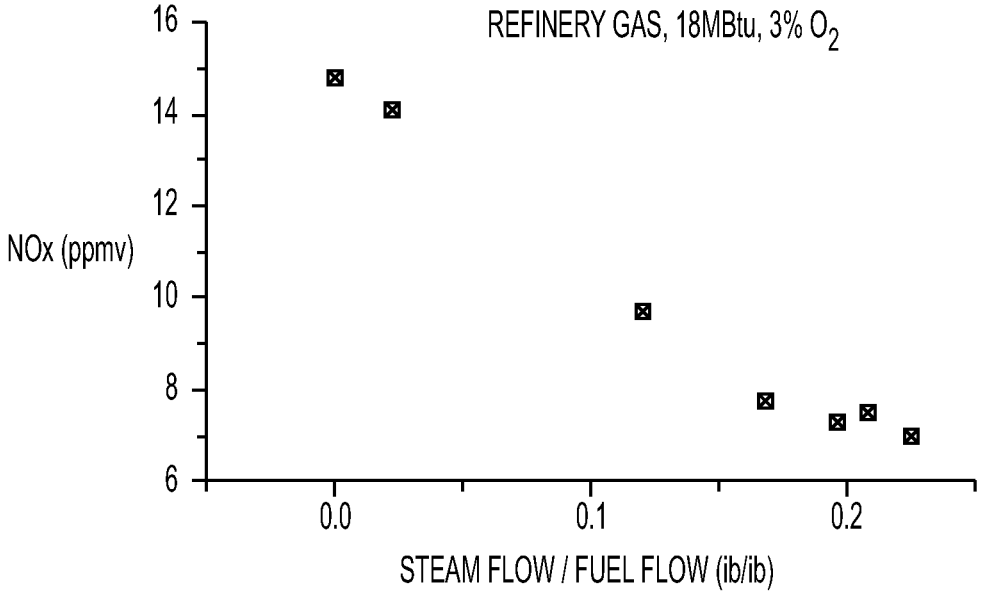
FIG. 5 exhibits NOx emissions measured from the flue gas of a combustion device for various steam to fuel ratios.

Refinery gas (e.g., typically containing $CH_4$, $C_3H_8$, $H_2$ and $CO_2$) was supplied to a three commercial grade Ultra Low NOx Burners at a firing rate of about 6 MBTU/hr. Flame stability was measured with a set of five pressure sensors and a machine vision sensor system with one high-temperature furnace camera and thirteen analysis sections within the optical image. Computation of flame stability was the average and normalized variance of all measurements from each type of sensor, including a software-based high pass filter. Steam was added to the fuel to reduce measured NOx emissions until flame instability was detected. During the test, between 0 and 0.23 lbs of steam per lb of fuel was added. NOx (ppm) emissions were determined and the results are set forth in FIG. 5. The emissions were obtained from sensors located in the flue stack. As shown in FIG. 5, NOx emissions decreased as the amount of steam was increased. Two-fold $NO_x$ reductions was achieved during this test upon addition of diluent.

Figure 6:
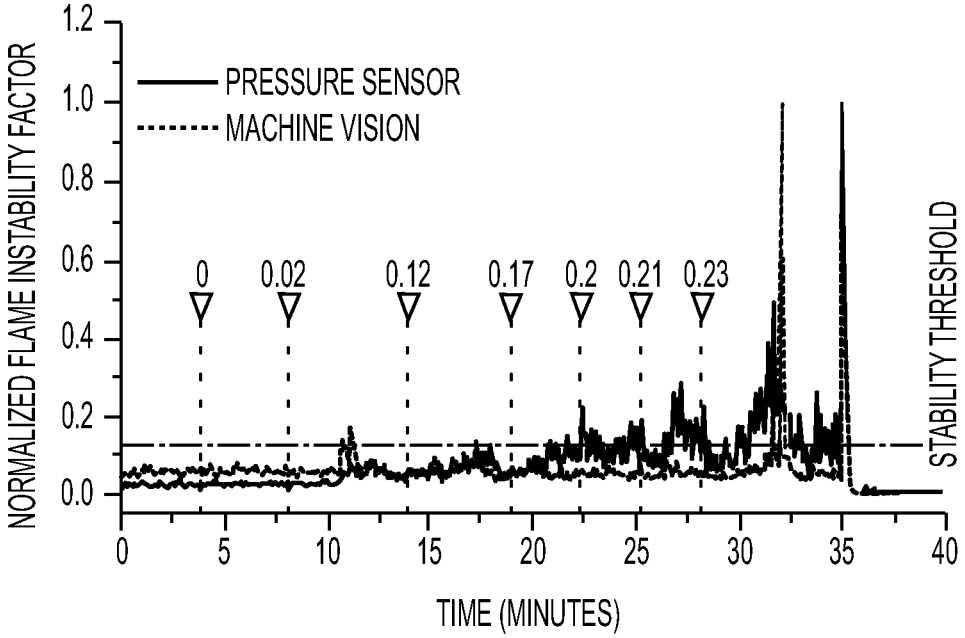
FIG. 6 displays normalized flame instability outputs derived from pressure sensors and a machine vision sensor system employing a high-temperature furnace camera used to monitor flame stability in a combustion device with increasing fractions of steam added to the fuel gas, as set forth in FIG. 5, over time.

Based on results from this example, NOx emissions and the "F" value of the flame sensors, as determined based on the protocol set forth above, was plotted versus time with increasing volume ratios of steam:fuel, where the steam was gradually increased as a fraction of the fuel. Some air is fed to the flame as an oxidant. The results in FIG. 5 and FIG. 6 show that the highest steam addition levels correspond to the greatest reduction in NOx and to the greatest instability signal (F), regardless of sensor type. This demonstrates a strategy whereby a critical instability threshold can be defined, as illustrated in FIG. 6 for descriptive purposes, and this signal can be used in a feedback control strategy to constrain the diluent flow to the burner in order to maintain stable operation while achieving the lowest possible NOx emissions.

Flame instability accompanies NOx reduction, and this instability is caused by the increase use of diluent. It is possible to identify a critical threshold value of F, $F_{Threshold}$, that identifies unstable operation well before blow-out or extinction occurs, particularly, for example, in embodiments employing real-time feed back or feed forward control based on use of a sensor described in this example using an acoustic sensor or machine vision sensor system to determine flame instability, or any type of flame stability sensor encompassed by any of the claims of the present application.

The present invention is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims (e.g., a Wavelength Modulated TDL sensor employing only one wavelength for measuring flame stability with or without wavelength-multiplexing, through the implementation of various wavelength modulation waveforms and/or modulation frequencies, and various strategies for manipulating raw data to arrive at a value indicative of flame stability, flame instability, and/or likelihood for LBO). While the present invention has been described in connection with a combustion device 1 in a refining/petrochemical processing application, the applicability of the present invention is not intended to be so limiting. It is contemplated that the present invention may be utilized in any combustion device utilizing a fuel gas as a fuel source including but not limited to power generation, steel/metal production and processing, glass production and paper production.

It is further to be understood that all values are approximate, and are provided for description.

Patents, patent applications, publications, product descriptions, and protocols are cited throughout this application, the disclosures of each of which is incorporated herein by reference in its entirety for all purposes.

The invention claimed is:

1. A method of controlling the operation of a combustion device to reduce NOx emission from the combustion device, wherein the combustion device having a flame, comprising:

providing a flow of fuel from a fuel source and diluent from a diluent source at a determined volume ratio to a flame in the combustion device;

providing at least one flame stability sensor to generate a measurement of a characteristic of the flame;

determining a predetermined critical flame instability threshold using a controller, wherein the controller determines the predetermined critical flame instability threshold from calculation of a flame stability factor F, wherein $$F \propto \frac{C \times \sum_{f_l}^{f_h} \left| FT_{t_i}^{t_f}(R) \right|}{\sum_{f_{min}}^{f_{max}} \left| FT_{t_i}^{t_f}(R) \right|}$$

wherein F is determined by the ratio of the sum of frequency content for two specified frequency ranges from a frequency spectrum, $f_l$ to $f_h$ and $f_{min}$ to $f_{max}$, such that $f_{min} \leq f_l < f_h \leq f_{max}$, wherein R is a time varying measurement signal, wherein FT denotes a short-time Fourier transform performed on R from a rolling initial point in time of the measurement, $t_i$, to a rolling final point in time of the measurement, $t_f$, such that $t_i < t_f$, wherein C is a scalar value used to manipulate the amplitude of F, wherein $$C \propto \sum_{f_{min}}^{f_{max}} \left| FT_{t_i}^{t_f}(R) \right|$$

and controlling the determined volume ratio of fuel:diluent using the controller based upon at least one of (i) at least one threshold value from at least one measurement from the at least one flame stability sensor, and (ii) at least one flow measurement from each of the fuel source and diluent source, wherein controlling the determined volume ratio of fuel:diluent includes decreasing the volume ratio of fuel:diluent until the predetermined critical flame instability threshold is reached to reduce NOx emission from the combustion device and increasing the volume ratio of fuel:diluent when predetermined critical flame instability threshold is exceeded, wherein the controlling the determined volume ratio of fuel:diluent includes adjusting at least one of the flow of the fuel from the fuel source and the flow of the diluent from the diluent source.

2. The method of claim 1, wherein the at least one flame stability sensor is at least one of an optical sensor, an acoustic sensor and a machine vision sensor.

3. The method of claim 2, wherein the optical sensor comprises at least one laser, controlling electronics, at least one detector, and a data acquisition and processing system that produces an actionable signal transmitted to a process controller to aid in the control of the fuel:diluent ratio.

4. The method of claim 3, wherein the optical sensor is a wavelength modulated tunable diode laser (TDL) sensor with at least one laser tuned to at least one pre-selected wavelength with or without wavelength-multiplexing.

5. The method according to claim 2, wherein the at least one flame stability sensor is an acoustic sensor.

6. The method according to claim 5, wherein the acoustic sensor is a pressure differential sensor.

7. The method according to claim 2, wherein the at least one flame stability sensor is a machine vision sensor.

8. The method according to claim 7, wherein the machine vision sensor includes at least one camera.

9. The method of claim 1, wherein the characteristic of the flame is selected from at least one of flame ionization, flame shape, flame mixing patterns, flame composition, flame temperature, smoke associated with the flame, acoustical noise, and light emitted from the flame.

10. The method according to claim 9, wherein the characteristic is directly measurable by the at least one flame stability sensor.

11. The method according to claim 9, wherein the characteristic is indirectly measurable by the at least one flame stability sensor.

12. The method of claim 1, wherein the diluent comprises a fluid selected from nitrogen, steam, carbon dioxide, recycled combustion gas or a combination thereof.

13. The method of claim 12, wherein the diluent comprises superheated steam.

14. The method of claim 12, wherein the diluent comprises at least 80% by volume of nitrogen.

15. The method of claim 12, wherein the diluent comprises at least 1% by volume of carbon dioxide.

16. The method of claim 1, wherein the combustion device is one of a furnace and a boiler.

17. The method of claim 1, wherein controlling the determined volume ratio of fuel:diluent is performed in real-time.

18. The method of claim 1, wherein the fuel is a fuel gas.

19. The method of claim 1, wherein the controlling the determined volume ratio of fuel:diluent provides safe operation of the combustion device.

20. The method according to claim 1, wherein the flame stability sensor comprises a device that generates an optical image that is digitized, wherein the digitized image is processed by a controller that can generate a threshold value to differentiate between stable and unstable flame conditions and provide an output to calculate the predetermined critical flame instability threshold and control the volume ratio of fuel:diluent.

21. The method according to claim 1, wherein the flame stability sensor comprises a device that measures a time varying flame characteristic either directly or indirectly indicative of flame instability, whereby a control signal is generated to calculate the predetermined critical flame instability threshold and control the volume ratio of fuel:diluent.

22. A combustion system comprising:

a combustion device;

a fuel source;

a diluent source;

a flow system in communication with the fuel source and the diluent source to provide a flow of fuel and diluent at a determined volume ratio to a flame in the combustion device;

at least one flame stability sensor to generate at least one measurement of at least one characteristic of the flame; and a controller to control the determined volume ratio of fuel:diluent based upon at least one of (i) a threshold value from at least one measurement from at least one flame stability sensor and (ii) a threshold volume ratio of fuel:diluent as measured by at least one flow measurement from each of the fuel source and the diluent source, wherein the controller decreases the volume ratio of fuel:diluent until a predetermined critical flame instability threshold is reached and increases the volume ratio of fuel:diluent when the predetermined critical flame instability threshold is exceeded, wherein the controller adjusting the determined volume ratio of fuel:diluent includes adjusting at least one of the flow of the fuel from the fuel source and the flow of the diluent from the diluent source, wherein the controller determines the predetermined critical flame instability threshold, wherein the predetermined critical flame instability threshold is determined from calculation of a flame stability factor F, wherein $$F \propto \frac{C \times \sum_{f_l}^{f_h} \left| FT_{t_i}^{t_f}(R) \right|}{\sum_{f_{min}}^{f_{max}} \left| FT_{t_i}^{t_f}(R) \right|}$$

wherein F is determined by the ratio of the sum of frequency content for two specified frequency ranges from a frequency spectrum, $f_l$ to $f_h$ and $f_{min}$ to $f_{max}$, such that $f_{min} \leq f_l < f_h \leq f_{max}$, wherein R is a time varying measurement signal, wherein FT denotes a short-time Fourier transform performed on R from a rolling initial point in time of the measurement, $t_i$, to a rolling final point in time of the measurement, $t_f$, such that $t_i < t_f$, wherein C is a scalar value used to manipulate the amplitude of F, wherein $$C \propto \sum_{f_{min}}^{f_{max}} \left| FT_{t_i}^{t_f}(R) \right|.$$

23. The combustion system of claim 22, wherein the flame stability sensor is at least one of an optical sensor, an acoustic sensor and a machine vision sensor.

24. The combustion system of claim 23, wherein the optical sensor comprises at least one laser.

25. The combustion system of claim 24, wherein the laser is a wavelength modulated tunable diode laser (TDL) sensor tuned to at least one pre-selected wavelength.

26. The combustion system of claim 25, wherein the wavelength modulated TDL sensor has wavelength-multiplexing.

27. The combustion system according to claim 22, wherein the at least one flame stability sensor is an acoustic sensor.

28. The combustion system according to claim 27, wherein the acoustic sensor is a pressure differential sensor.

29. The combustion system according to claim 22, wherein the at least one flame stability sensor is a machine vision sensor.

30. The combustion system according to claim 29, wherein the machine vision sensor includes at least one camera.

31. The combustion system of claim 22, wherein the characteristic of the flame is at least one of flame ionization, flame shape, flame mixing patterns, flame composition, flame temperature, smoke associated with the flame, acoustical noise and light emitted from the flame.

32. The combustion system according to claim 31, wherein the characteristic is directly measurable by the at least one flame stability sensor.

33. The combustion system according to claim 31, wherein the characteristic is indirectly measurable by the at least one flame stability sensor.

34. The combustion system of claim 22, wherein the diluent comprises a fluid selected from a group consisting of nitrogen, steam, carbon dioxide, recycled combustion gas and a combination thereof.

35. The combustion system of claim 34, wherein the diluent comprises superheated steam.

36. The combustion system of claim 35, wherein the diluent comprises at least 80% by volume of nitrogen.

37. The combustion system of claim 34, wherein the diluent comprises at least 1% by volume of carbon dioxide.

38. The combustion system of claim 22, wherein the combustion device is one of a furnace and a boiler.

39. The combustion system of claim 22, wherein the controller provides real-time control.

* * * * *